US010439299B2

(12) United States Patent
Black et al.

(10) Patent No.: US 10,439,299 B2
(45) Date of Patent: Oct. 8, 2019

(54) ANTENNA SYSTEMS AND METHODS FOR MODULATING AN ELECTROMAGNETIC PROPERTY OF AN ANTENNA

(71) Applicant: Searete LLC, Bellevue, WA (US)

(72) Inventors: Eric J. Black, Bothell, WA (US); Brian Mark Deutsch, Snoqualmie, WA (US); Alexander Remley Katko, Bellevue, WA (US); Melroy Machado, Seattle, WA (US); Jay Howard McCandless, Alpine, CA (US); Yaroslav A. Urzhumov, Bellevue, WA (US)

(73) Assignee: The Invention Science Fund I, LLC, Bellevue, WA (US)

( * ) Notice: Subject to any disclaimer, the term of this patent is extended or adjusted under 35 U.S.C. 154(b) by 185 days.

(21) Appl. No.: 15/489,575

(22) Filed: Apr. 17, 2017

(65) Prior Publication Data

US 2018/0301821 A1 Oct. 18, 2018

(51) Int. Cl.

| | |
|---|---|
| ***H01Q 21/29*** | (2006.01) |
| ***H01Q 3/26*** | (2006.01) |
| ***H01Q 3/44*** | (2006.01) |
| ***H01Q 15/00*** | (2006.01) |
| ***H01Q 3/24*** | (2006.01) |
| ***H01Q 21/24*** | (2006.01) |

(52) U.S. Cl.

CPC ..... *H01Q 21/293* (2013.01); *H01Q 3/247* (2013.01); *H01Q 3/26* (2013.01); *H01Q 3/2682* (2013.01); *H01Q 3/44* (2013.01); *H01Q 15/0066* (2013.01); *H01Q 21/24* (2013.01)

(58) Field of Classification Search

CPC ..... H01Q 21/293; H01Q 21/24; H01Q 3/24; H01Q 3/26; H01Q 3/2682; H01Q 3/44; H01Q 15/0066; H01Q 21/29; H01Q 3/247

See application file for complete search history.

(56) References Cited

U.S. PATENT DOCUMENTS

| | | | | |
|---|---|---|---|---|
| 2015/0109181 | A1* | 4/2015 | Hyde | H01Q 15/0053 343/833 |
| 2015/0236412 | A1* | 8/2015 | Bily | H01Q 3/34 342/374 |
| 2015/0288063 | A1 | 10/2015 | Johnson et al. | |
| 2016/0233588 | A1 | 8/2016 | Bily et al. | |
| 2016/0261043 | A1* | 9/2016 | Sazegar | H01Q 3/34 |
| 2018/0097286 | A1 | 4/2018 | Black et al. | |

FOREIGN PATENT DOCUMENTS

WO WO 2015/196044 A1 12/2015

OTHER PUBLICATIONS

PCT International Search Report; International App. No. PCT/2018/027773; dated Jul. 27, 2018; pp. 1-4.

* cited by examiner

*Primary Examiner* — Hoang V Nguyen

(57) ABSTRACT

Antenna systems and related methods are disclosed. An antenna system includes an antenna controller configured to operably couple to control inputs of an antenna including an array of electromagnetic (EM) scattering elements. A method includes controlling an array of EM scattering elements to operate according to holographic modulation patterns, and modulating at least one effective EM property of the antenna over space, time, or a combination thereof to, in the average and/or the aggregate, cause side lobes of an antenna gain of the antenna to be reduced.

41 Claims, 3 Drawing Sheets

ANTENNA SYSTEMS AND METHODS FOR MODULATING AN ELECTROMAGNETIC PROPERTY OF AN ANTENNA

If an Application Data Sheet (ADS) has been filed on the filing date of this application, it is incorporated by reference herein. Any applications claimed on the ADS for priority under 35 U.S.C. §§ 119, 120, 121, or 365(c), and any and all parent, grandparent, great-grandparent, etc. applications of such applications, are also incorporated by reference, including any priority claims made in those applications and any material incorporated by reference, to the extent such subject matter is not inconsistent herewith.

CROSS-REFERENCE TO RELATED APPLICATIONS

The present application claims the benefit of the earliest available effective filing date(s) from the following listed application(s) (the "Priority Applications"), if any, listed below (e.g., claims earliest available priority dates for other than provisional patent applications or claims benefits under 35 U.S.C. § 119(e) for provisional patent applications, for any and all parent, grandparent, great-grandparent, etc. applications of the Priority Application(s)).

Priority Applications:

None

If the listings of applications provided above are inconsistent with the listings provided via an ADS, it is the intent of the Applicant to claim priority to each application that appears in the Domestic Benefit/National Stage Information section of the ADS and to each application that appears in the Priority Applications section of this application.

All subject matter of the Priority Applications and of any and all applications related to the Priority Applications by priority claims (directly or indirectly), including any priority claims made and subject matter incorporated by reference therein as of the filing date of the instant application, is incorporated herein by reference to the extent such subject matter is not inconsistent herewith.

DETAILED DESCRIPTION

Figure 1:
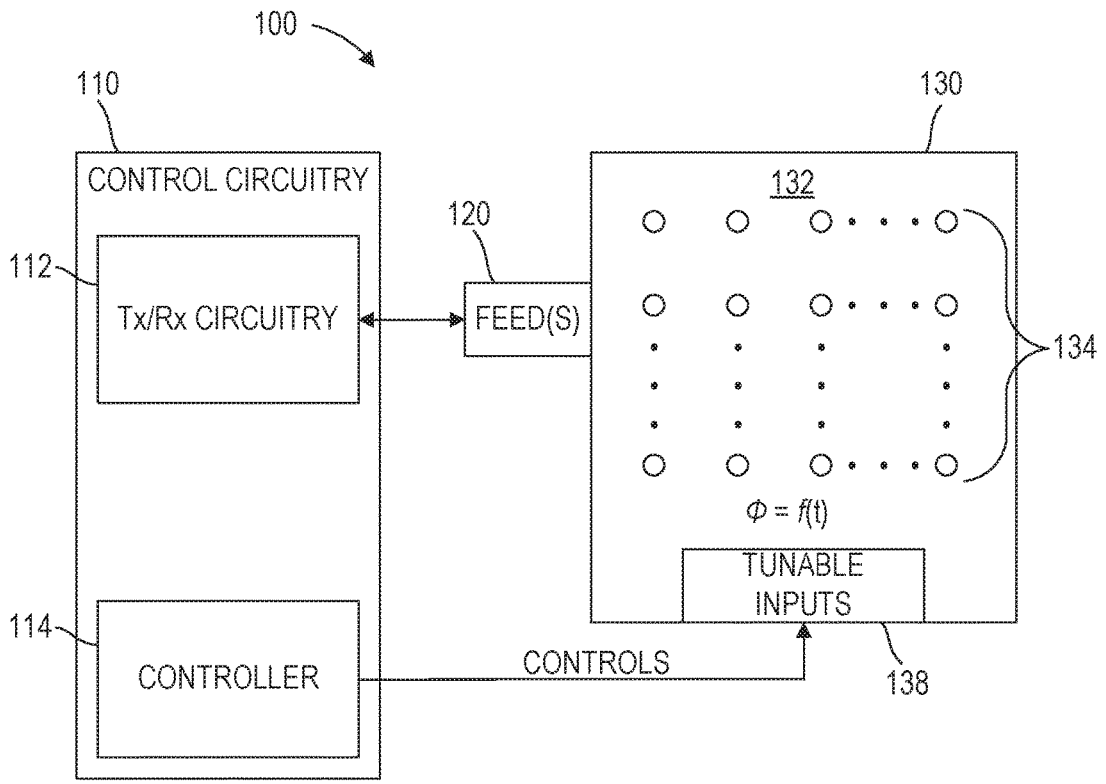
FIG. 1 is a simplified block diagram illustrating an antenna system, according to some embodiments.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

Improvements to holographic beamforming antennas are disclosed herein. More particularly, improvements to holographic beamforming antennas based on Metamaterial Surface Scattering Technology (MSA-T) are disclosed herein.

In antennas based on MSA-T, coupling between a guided wave and a propagating wave is achieved by modulating a pattern of impedance or impedances of a surface in electromagnetic contact with the guided wave. This controlled surface impedance or impedances is called a "modulation pattern," or "modulation patterns." The guided wave in the antenna is referred to as an "EM reference wave," a "reference wave," or a "Reference Mode," and a desired free space propagating wave pattern is referred to as an "EM radiative wave," a "radiative wave" or "radiative mode."

A modulation pattern for achieving a desired radiative wave $E_{rad}$ may be estimated in MSA-T from holographic principles. In holography, the surface modulation function is a hologram $\psi_{hol}$ formed by a beat of the reference wave $E_{ref}$ and the desired radiative wave $E_{rad}$. This relationship can be expressed as:

$$\psi_{holo} = \frac{E_{ref}^{*} E_{rad}}{|E_{ref}|^2}.$$

This equation suggests that the optimal modulation function may depend on the accuracy to which the radiative wave $E_{rad}$ and the reference wave $E_{ref}$ are known.

MSA-T antennas include arrays of discrete EM scattering elements with sub-wavelength element spacing (e.g., less than or equal to half an operational frequency, less than or equal to a quarter wavelength of the operational frequency, etc.). Radiation from each of the EM scattering elements can be discretely modulated such that their collective effect approximates a modulation pattern (e.g., a desired modulation pattern for achieving a desired EM radiative wave).

If both the reference wave $E_{ref}$ and the radiative wave $E_{rad}$ are normalized, the function $\psi_{holo}$ can take on any value in the complex plane in a circle with magnitude less than 1. The modulating elements used in typical MSA-T antennas, however, are frequently incapable of completely covering this complex unit circle. Therefore, the modulation function may be adjusted to reflect the modulation values the EM scattering elements can achieve. In addition, the surface is discretely sampled at fixed locations, leading any choice of modulation pattern to be a sampled approximation of a theoretical continuous modulation pattern.

Disclosed herein are systems and methods for decreasing side lobes for dynamically tunable holographic antennas (e.g., MSA-T antennas) by dynamically modulating EM properties of the antennas over time and/or over space. A brief list of example embodiments follows. In the interest of brevity and avoiding complexity, not each of these examples is explicitly identified as combinable with each of the other of the examples, and other examples and embodiments disclosed herein. Each of these examples, and other examples and embodiments disclosed herein, is, however, contemplated as combinable, unless explicitly indicated otherwise or otherwise apparent to one of skill in the art as not combinable.

In some embodiments, an antenna system includes an antenna controller configured to operably couple to control inputs of an antenna including an array of electromagnetic (EM) scattering elements having sub-wavelength spacing and carried by a body configured to propagate an EM reference wave. The antenna controller is configured to control the array of EM scattering elements, through the control inputs, to operate according to a holographic modulation pattern, and control the array of EM scattering elements to modulate at least one effective EM property of the antenna itself over time to, on average, cause side lobes of an antenna gain of the antenna to be reduced.

In some embodiments, an antenna system includes an antenna controller configured to modulate a spatial holographic phase of an antenna over time.

In some embodiments, an antenna system includes an antenna controller configured to modulate a spatial holographic phase of an antenna over time by switching the antenna between a holographic modulation pattern having a first spatial holographic phase and another holographic modulation pattern having a second spatial holographic phase that is different from the first spatial holographic phase.

In some embodiments, an antenna system includes an antenna controller configured to modulate a spatial holographic phase of an antenna over time by switching the antenna between a holographic modulation pattern and two or more other holographic modulation patterns, the holographic modulation pattern and the two or more other holographic modulation patterns each having different spatial holographic phases.

In some embodiments, an antenna system includes an antenna controller configured to modulate a spatial holographic phase of an antenna over time according to a single-frequency sinusoidal function of time.

In some embodiments, an antenna system includes an antenna controller configured to modulate a spatial holographic phase of an antenna over time according to a rectangular periodic function of time.

In some embodiments, an antenna system includes an antenna controller configured to modulate a spatial holographic phase of an antenna over time according to a periodic function of time.

In some embodiments, an antenna system includes an antenna controller configured to modulate a spatial holographic phase of an antenna over time according to an aperiodic function of time.

In some embodiments, an antenna system includes an antenna controller configured to modulate a spatial holographic phase of an antenna over time according to a random aperiodic function of time.

In some embodiments, an antenna system includes an antenna controller configured to modulate an effective mode index of an antenna over time.

In some embodiments, an antenna system includes an antenna controller configured to modulate an effective mode index of an antenna over time by switching the antenna between a holographic modulation pattern having a first effective mode index and a second holographic modulation pattern having a second effective mode index that is different from the first effective mode index.

In some embodiments, an antenna system includes an antenna controller configured to modulate an effective mode index of an antenna over time by switching the antenna between a holographic modulation pattern and two or more other holographic modulation patterns, the holographic modulation pattern and the two or more other holographic modulation patterns each having different effective mode indices.

In some embodiments, an antenna system includes an antenna controller configured to modulate an effective mode index of an antenna over time according to a single frequency sinusoidal function of time.

In some embodiments, an antenna system includes an antenna controller configured to modulate an effective mode index of the antenna over time according to a rectangular periodic function of time.

In some embodiments, an antenna system includes an antenna controller configured to modulate an effective mode index of the antenna over time according to a periodic function of time.

In some embodiments, an antenna system includes an antenna controller configured to modulate an effective mode index of an antenna over time according to an aperiodic function of time.

In some embodiments, an antenna system includes an antenna controller configured to modulate an effective mode index of an antenna over time according to a random aperiodic function of time.

In some embodiments, an antenna system includes an antenna controller configured to modulate both a spatial holographic phase and an effective mode index of an antenna over time.

In some embodiments, an antenna system includes a body and EM scattering elements of an array, wherein the EM scattering elements are configured to scatter EM energy at least one of from an EM reference wave to an EM radiative wave, or from the EM radiative wave to the EM reference wave.

In some embodiments, an antenna system includes EM scattering elements spaced at less than about one half of a wavelength of an operational frequency of the antenna system.

In some embodiments, an antenna system includes EM scattering elements spaced at less than about one fourth of a wavelength of an operational frequency of the antenna system.

In some embodiments, an antenna system includes one or more feeds configured to deliver an EM reference wave to or receive the EM reference wave from a body.

In some embodiments, an antenna system includes signal generating circuitry configured to operably couple to and deliver a signal to one or more feeds, the signal configured to excite an EM reference wave on or in a body.

In some embodiments, an antenna system includes signal processing circuitry configured to operably couple to and receive a signal from one or more feeds, the signal configured to be excited from an EM reference wave on or in a body.

In some embodiments, an antenna system includes EM scattering elements arranged in a one-dimensional arrangement.

In some embodiments, an antenna system includes EM scattering elements arranged in a plurality of one-dimensional arrangements.

In some embodiments, an antenna system includes EM scattering elements arranged in at least a two-dimensional arrangement.

In some embodiments, an antenna system includes EM scattering elements arranged in at least a three-dimensional arrangement.

In some embodiments, an antenna system includes an antenna controller configured to operably couple to control inputs of an antenna including an array of electromagnetic (EM) scattering elements having sub-wavelength spacing and carried by a body configured to propagate an EM reference wave. The antenna controller is configured to control the array of EM scattering elements, through the control inputs, to operate according to holographic modulation patterns, and control the array of EM scattering elements to modulate the effective EM properties of the antenna itself over separate segments of the antenna to, in the aggregate, cause the side lobes of the antenna gain of the antenna to be reduced.

In some embodiments, an antenna system includes an antenna controller configured to modulate a spatial holographic phase over separate segments of an antenna.

In some embodiments, an antenna system includes an antenna including separate segments, wherein each of the separate segments of the antenna corresponds to a separate one-dimensional arrangement of a portion of EM scattering elements of an array of EM scattering elements.

In some embodiments, an antenna system includes an antenna controller configured to modulate a spatial holographic phase over separate segments of an antenna by controlling the separate segments to operate with two different spatial holographic phases in at least two of the separate segments.

In some embodiments, an antenna system includes an antenna controller configured to modulate a spatial holographic phase over separate segments of an antenna by controlling the separate segments to operate with more than two different spatial holographic phases in more than two of the separate segments.

In some embodiments, an antenna system includes an antenna controller configured to modulate a spatial holographic phase over separate segments of an antenna according to a single frequency sinusoidal function of space.

In some embodiments, an antenna system includes an antenna controller configured to modulate a spatial holographic phase over separate segments of an antenna according to a rectangular periodic function of space.

In some embodiments, an antenna system includes an antenna controller configured to modulate a spatial holographic phase over separate segments of an antenna according to a periodic function of space.

In some embodiments, an antenna system includes an antenna controller configured to modulate a spatial holographic phase over separate segments of an antenna according to an aperiodic function of space.

In some embodiments, an antenna system includes an antenna controller configured to modulate a spatial holographic phase over separate segments of an antenna according to a random aperiodic function of space.

In some embodiments, an antenna system includes an antenna controller configured to modulate an effective mode index over separate segments of an antenna.

In some embodiments, an antenna system includes separate segments of an antenna, each corresponding to a separate one-dimensional arrangement of a portion of an array of EM scattering elements.

In some embodiments, an antenna system includes an antenna controller configured to modulate effective mode indices over separate segments of an antenna by controlling the separate segments of the antenna to operate with two different effective mode indices in at least two of the separate segments.

In some embodiments, an antenna system includes an antenna controller configured to modulate effective mode indices over separate segments of an antenna by controlling the separate segments of the antenna to operate with more than two different effective mode indices in more than two of the separate segments.

In some embodiments, an antenna system includes an antenna controller configured to modulate effective mode indices over separate segments of an antenna according to a single frequency sinusoidal function of space.

In some embodiments, an antenna system includes an antenna controller configured to modulate effective mode indices over separate segments of an antenna according to a rectangular periodic function of space.

In some embodiments, an antenna system includes an antenna controller configured to modulate effective mode indices over separate segments of an antenna according to a periodic function of space.

In some embodiments, an antenna system includes an antenna controller configured to modulate effective mode indices over separate segments of an antenna according to an aperiodic function of space.

In some embodiments, an antenna system includes an antenna controller configured to modulate effective mode indices over separate segments of an antenna according to a random aperiodic function of space.

In some embodiments, an antenna system includes an antenna controller configured to control an array of EM scattering elements of an antenna to modulate both a spatial holographic phase and an effective mode index of the antenna over separate segments of the antenna.

In some embodiments, an antenna system includes a body and EM scattering elements of an array, wherein the EM scattering elements are configured to scatter EM energy at least one of from an EM reference wave to an EM radiative wave, and from the EM radiative wave to the EM reference wave.

In some embodiments, an antenna system includes EM scattering elements spaced at less than about one half of a wavelength of an operational frequency of the antenna system.

In some embodiments, an antenna system includes EM scattering elements spaced at less than about one fourth of a wavelength of an operational frequency of the antenna system.

In some embodiments, an antenna system includes one or more feeds configured to at least one of deliver an EM reference wave to or receive the EM reference wave from a body.

In some embodiments, an antenna system includes signal generating circuitry configured to operably couple to and deliver a signal to one or more feeds, the signal configured to excite an EM reference wave on or in a body.

In some embodiments, an antenna system includes signal processing circuitry configured to operably couple to and receive a signal from one or more feeds, the signal configured to be excited from an EM reference wave on or in a body.

In some embodiments, an antenna system includes EM scattering elements arranged in a one-dimensional arrangement.

In some embodiments, an antenna system an antenna system includes EM scattering elements arranged in a plurality of one-dimensional arrangements.

In some embodiments, an antenna system includes EM scattering elements arranged in at least a two-dimensional arrangement.

In some embodiments, an antenna system includes EM scattering elements arranged in at least a three-dimensional arrangement.

In some embodiments, a method of operating an antenna system includes controlling an array of electromagnetic (EM) scattering elements of an antenna through control inputs of the antenna to operate according to a holographic modulation pattern. The array of EM scattering elements have sub-wavelength spacing, and is carried by a body configured to propagate an EM reference wave. The method also includes controlling the array of EM scattering elements to modulate at least one effective EM property of the antenna itself over time to, on average, cause side lobes of an antenna gain of the antenna to be reduced.

In some embodiments, a method includes controlling an array of EM scattering elements, which includes modulating a spatial holographic phase of an antenna over time.

In some embodiments, a method includes modulating a spatial holographic phase of an antenna over time, which includes switching the antenna between a holographic modulation pattern having a first spatial holographic phase and another holographic modulation pattern having a second spatial holographic phase that is different from the first spatial holographic phase.

In some embodiments, a method includes modulating a spatial holographic phase of an antenna over time, which includes switching the antenna between a holographic modulation pattern and two or more other holographic modulation patterns, the holographic modulation pattern and the two or more other holographic modulation patterns each having different spatial holographic phases.

In some embodiments, a method includes modulating a spatial holographic phase of an antenna over time, which includes modulating the spatial holographic phase of the antenna according to a single-frequency sinusoidal function of time.

In some embodiments, a method includes modulating a spatial holographic phase of an antenna over time, which includes modulating the spatial holographic phase of the antenna over time according to a rectangular periodic function of time.

In some embodiments, a method includes modulating a spatial holographic phase an antenna over time, which includes modulating the spatial holographic phase of the antenna over time according to a periodic function of time.

In some embodiments, a method includes modulating a spatial holographic phase of an antenna over time, which includes modulating the spatial holographic phase of the antenna over time according to an aperiodic function of time.

In some embodiments, a method includes modulating a spatial holographic phase of an antenna over time, which includes modulating the spatial holographic phase of the antenna over time according to a random aperiodic function of time.

In some embodiments, a method includes controlling an array of EM scattering elements, which includes modulating an effective mode index of an antenna over time.

In some embodiments, a method includes modulating an effective mode index of an antenna over time, which includes switching an antenna between a holographic modulation pattern having a first effective mode index and a second holographic modulation pattern having a second effective mode index that is different from the first effective mode index.

In some embodiments, a method includes modulating an effective mode index of an antenna over time, which includes switching the antenna between a holographic modulation pattern and two or more other holographic modulation patterns, the holographic modulation pattern and the two or more other holographic modulation patterns each having different effective mode indices.

In some embodiments, a method includes modulating an effective mode index of an antenna over time, which includes modulating the effective mode index of the antenna over time according to a single frequency sinusoidal function of time.

In some embodiments, a method includes modulating an effective mode index of an antenna over time, which includes modulating the effective mode index of the antenna over time according to a rectangular periodic function of time.

In some embodiments, a method includes modulating an effective mode index of an antenna over time, which includes modulating the effective mode index of the antenna over time according to a periodic function of time.

In some embodiments, a method includes modulating an effective mode index of an antenna over time, which includes modulating the effective mode index of the antenna over time according to an aperiodic function of time.

In some embodiments, a method includes modulating an effective mode index of an antenna over time, which includes modulating the effective mode index of the antenna over time according to a random aperiodic function of time.

In some embodiments, a method includes controlling an array of EM scattering elements, which includes modulating both a spatial holographic phase and an effective mode index of an antenna over time.

In some embodiments, a method includes scattering EM energy from an EM reference wave to an EM radiative wave, or scattering EM energy from the EM radiative wave to the EM reference wave.

In some embodiments, a method includes controlling an array of EM scattering elements, which includes controlling EM scattering elements spaced at less than about one half of a wavelength of an operational frequency of an antenna system.

In some embodiments, a method includes controlling an array of EM scattering elements, which includes controlling EM scattering elements spaced at less than about one fourth of a wavelength of an operational frequency of an antenna system.

In some embodiments, a method includes delivering an EM reference wave to or receiving the EM reference wave from a body with one or more feeds.

In some embodiments, a method includes delivering a signal to one or more feeds with signal generating circuitry operably coupled to the one or more feeds, the signal configured to excite an EM reference wave on or in a body.

In some embodiments, a method includes receiving a signal from one or more feeds, the signal configured to be excited from an EM reference wave on or in a body.

In some embodiments, a method includes controlling an array of EM scattering elements, which includes controlling EM scattering elements arranged in a one-dimensional arrangement.

In some embodiments, a method includes controlling an array of EM scattering elements, which includes controlling EM scattering elements arranged in a plurality of one-dimensional arrangements.

In some embodiments, a method includes controlling an array of EM scattering elements, which includes controlling EM scattering elements arranged in at least a two-dimensional arrangement.

In some embodiments, a method includes controlling an array of EM scattering elements, which includes controlling EM scattering elements arranged in at least a three-dimensional arrangement.

In some embodiments, a method of operating an antenna system includes controlling an array of electromagnetic (EM) scattering elements of an antenna through control inputs of the antenna to operate according to holographic modulation patterns, the array of EM scattering elements having sub-wavelength spacing and carried by a body configured to propagate an EM reference wave. The method also includes controlling the array of EM scattering elements to modulate effective EM properties of the antenna itself over separate segments of the antenna to, in the aggregate, cause side lobes of an antenna gain of the antenna to be reduced.

In some embodiments, a method includes controlling an array of EM scattering elements, which includes modulating a spatial holographic phase over separate segments of an antenna.

In some embodiments, a method includes modulating a spatial holographic phase over separate segments of an antenna, which includes modulating the spatial holographic phase over separate segments corresponding to separate one-dimensional arrangements of a portion of EM scattering elements of an array of EM scattering elements.

In some embodiments, a method includes modulating a spatial holographic phase over separate segments of an antenna, which includes controlling the separate segments to operate with two different spatial holographic phases in at least two of the separate segments.

In some embodiments, a method includes modulating a spatial holographic phase over separate segments of an antenna, which includes controlling the separate segments to operate with more than two different spatial holographic phases in more than two of the separate segments.

In some embodiments, a method includes modulating a spatial holographic phase over separate segments of an antenna, which includes modulating the spatial holographic phase over the separate segments according to a single frequency sinusoidal function of space.

In some embodiments, a method includes modulating a spatial holographic phase over separate segments of an antenna, which includes modulating the spatial holographic phase over the separate segments according to a rectangular periodic function of space.

In some embodiments, a method includes modulating a spatial holographic phase over separate segments of an antenna, which includes modulating the spatial holographic phase over the separate segments according to a periodic function of space.

In some embodiments, a method includes modulating a spatial holographic phase over separate segments of an antenna, which includes modulating the spatial holographic phase over the separate segments according to an aperiodic function of space.

In some embodiments, a method includes modulating a spatial holographic phase over separate segments of an antenna, which includes modulating the spatial holographic phase over the separate segments according to a random aperiodic function of space.

In some embodiments, a method includes controlling an array of EM scattering elements, which includes modulating an effective mode index over separate segments of an antenna.

In some embodiments, a method includes modulating an effective mode index over separate segments of an antenna, which includes modulating the effective mode index over separate segments of the antenna corresponding to separate one-dimensional arrangements of a portion of an array of EM scattering elements.

In some embodiments, a method includes modulating an effective mode index over separate segments of an antenna, which includes controlling the separate segments of the antenna to operate with two different effective mode indices in at least two of the separate segments.

In some embodiments, a method includes modulating an effective mode index over separate segments of an antenna, which includes controlling the separate segments of the antenna to operate with more than two different effective mode indices in more than two of the separate segments.

In some embodiments, a method includes modulating an effective mode index over separate segments of an antenna, which includes modulating effective mode indices of the antenna over the separate segments according to a single frequency sinusoidal function of space.

In some embodiments, a method includes modulating an effective mode index over separate segments of an antenna, which includes modulating effective mode indices over the separate segments according to a rectangular periodic function of space.

In some embodiments, a method includes modulating an effective mode index over separate segments of an antenna, which includes modulating effective mode indices over the separate segments according to a periodic function of space.

In some embodiments, a method includes modulating an effective mode index over separate segments of an antenna, which includes modulating effective mode indices over the separate segments according to an aperiodic function of space.

In some embodiments, a method includes modulating an effective mode index over separate segments of an antenna, which includes modulating effective mode indices over the separate segments according to a random aperiodic function of space.

In some embodiments, a method includes controlling an array of EM scattering elements, which includes modulating both a spatial holographic phase and an effective mode index of an antenna over separate segments of the antenna.

In some embodiments, a method includes scattering EM energy from an EM reference wave to an EM radiative wave, or scattering EM energy from the EM radiative wave to the EM reference wave.

In some embodiments, a method includes controlling an array of EM scattering elements, which includes controlling EM scattering elements spaced at less than about one half of a wavelength of an operational frequency of the antenna system.

In some embodiments, a method includes controlling an array of EM scattering elements, which includes controlling EM scattering elements spaced at less than about one fourth of a wavelength of an operational frequency of an antenna system.

In some embodiments, a method includes delivering an EM reference wave to or receiving the EM reference wave from a body with one or more feeds.

In some embodiments, a method includes delivering a signal to one or more feeds with signal generating circuitry operably coupled to the one or more feeds, the signal configured to excite an EM reference wave on or in a body.

In some embodiments, a method includes receiving a signal from one or more feeds, the signal configured to be excited from an EM reference wave on or in a body.

In some embodiments, a method includes controlling an array of EM scattering elements, which includes controlling EM scattering elements arranged in a one-dimensional arrangement.

In some embodiments, a method includes controlling an array of EM scattering elements, which includes controlling EM scattering elements arranged in a plurality of one-dimensional arrangements.

In some embodiments, a method includes controlling an array of EM scattering elements, which includes controlling EM scattering elements arranged in at least a two-dimensional arrangement.

In some embodiments, a method includes controlling an array of EM scattering elements, which includes controlling EM scattering elements arranged in at least a three-dimensional arrangement.

In adaptive holographic antennas (e.g., MSA-T antennas), temporal modulation of EM scattering elements is typically used to achieve scanning of a main lobe of a beam of an antenna gain. Time-dependent hologram modulation may be used to, on average, suppress one or more unwanted beams (e.g., "side lobes").

In holographic beamforming, some of the side lobes emerge due to aliasing. As used herein, the term "aliasing" refers to generation of more than one beam in the process of illuminating a desired holographic modulation pattern with a reference wave. A naïve modulation pattern for a one-dimensional holographic array may have the form given by:

$$\psi_{holo}(x)=\cos(k_0 x(\sin(\theta)+n_{eff})+\phi),$$

where θ is a nominal angle for radiation relative to array broadside, $$k_0 = \frac{2\pi}{\lambda}$$

is a free-space wavenumber related to λ (a free space wavelength), x is a space coordinate along the array, $n_{eff}$ is an effective mode index of the reference wave, and ϕ is a hologram phase (which is a spatial phase, and not to be confused with the phase of the reference wave in the time domain).

The result of illuminating the modulation pattern of $\psi_{holo}(x)$, as given above, with a plane-wave EM reference wave includes a main beam of an antenna gain directed at the angle θ relative to a normal of a plane formed by EM scattering elements (in the case of a two-dimensional array). Also, however, one or more "alias" beams (side lobes) may result in addition to the main beam. This is because the naïve holographic pattern $\psi_{holo}(x)$ is not an ideal blazed diffraction grating (even if it is implemented with infinite spatial resolution and infinite amplitude and phase level accuracy). As a result, more than one diffracted beam typically exists in the far field antenna gain.

Some of the secondary beams (side lobes) are sensitive to the spatial phase ϕ of the hologram. This is in contrast to the main beam, which is generally directed at the angle θ regardless of the phase ϕ. In other words, changing the phase ϕ does not tend to greatly change a magnitude or angle θ of the main beam. Consequently, creating a temporal or spatial modulation of the phase ϕ generally affects the angles of the side lobes much more than the main lobe. A time-dependent modulation pattern of the following form therefore leads to a beam pattern that, after temporal averaging over one period of phase modulation ($T=2\pi/\Omega$), has a reduced time-averaged gain (and broader time-averaged beamwidth) of the one or more side lobes:

$$\psi_{holo}(x, t)=\cos(k_0 x(\sin(\theta)+n_{eff})+\phi(t)),\ \phi(t)=\varphi_{max}\sin \Omega t.$$

The parameters $\Omega \ll \omega$ and $0<\omega_{max}<\pi$ can be chosen to maximize the suppression effect for a particular side lobe, while minimizing the degradation of the main lobe and the distortion of the signal transmitted through the main lobe.

The time dependence of the spatial phase may be based on functions of time other than a single frequency sinusoidal function of time. For example, this technique may be used with sign Ωt (rectangular periodic functions), other periodic functions, and random aperiodic functions of time.

FIG. 1 is a simplified block diagram illustrating an antenna system 100, according to some embodiments. The antenna system 100 includes control circuitry 110, one or more feeds 120, and an antenna 130. The antenna 130 includes a body 132 that carries an array of EM scattering elements 134. The EM scattering elements 134 have sub-wavelength spacing (e.g., uniform spacing, non-uniform spacing, or combinations thereof). The antenna 130 also includes control inputs 138 configured to adjust impedance of the EM scattering elements 134 responsive to controls (e.g., CONTROLS, as shown in FIG. 1) applied thereto.

The control circuitry 110 includes a transmit and/or receive circuitry 112 (sometimes referred to herein as "Tx/Rx circuitry" 112) and an antenna controller 114 (sometimes referred to herein as "controller" 114). It should be noted, however, that in some embodiments the Tx/Rx circuitry 112 and the controller 114 may be implemented in separate control circuitry 110. Furthermore, in some embodiments, the control circuitry 110 may not include TxRx circuitry 112. The controller 114 is configured to control the array of EM scattering elements 134, by applying the controls to the control inputs 138, to operate according to one or more holographic modulation patterns. The controller 114 is also configured to control the array of EM scattering elements 134 to modulate at least one effective EM property of the antenna 130 itself over time to, on average, cause side lobes of an antenna gain of the antenna 130 to be reduced.

In some embodiments, the EM property of the antenna 130 that is modulated over time is a spatial holographic phase of the antenna 130. In some embodiments, the EM property of the antenna 130 that is modulated is an effective mode index of the antenna 130. In some embodiments, the EM property of the antenna 130 that is modulated over time includes both the spatial holographic phase and the effective mode index of the antenna 130.

Different values for the effective EM property of the antenna 130, as modulated over time, correspond to different holographic modulation patterns, which are controlled by the controls applied to the control inputs 138 of the antenna 130 by the controller 114. Multiple different holographic modulation patterns can correspond to a same value for the effective EM property of the antenna 130, so care should be taken to be sure that in modulating the holographic modulation patterns to modulate the effective EM property, that the holographic modulation patterns are selected to change the effective EM property. The controller 114 is configured to select these holographic modulation patterns, and control the antenna 130 to operate according to the selected holographic modulation patterns by applying the controls to the control inputs 138.

By way of non-limiting example, the controller 114 may be configured to switch the antenna 130 between a first holographic modulation pattern corresponding to a first value of the effective EM property and a second holographic modulation pattern having a second value of the effective EM property, the first value being different from the second value. Also by way of non-limiting example, the controller 114 may be configured to switch the antenna 130 between a first holographic modulation pattern and two or more other holographic modulation patterns, the first holographic modulation pattern and the two or more other holographic modulation patterns each having different spatial holographic phases.

As previously discussed, the controller 114 may be configured to modulate the effective EM property of the antenna 130 according to any of various functions of time (f(t)). In some embodiments, the controller 114 may be configured to modulate the value of the effective EM property of the antenna 130 over time according to a periodic function of time (e.g., a rectangular periodic function of time, a single-frequency sinusoidal function of time, etc.). In some embodiments, the controller 114 may be configured to modulate the value of the effective EM property of the antenna 130 over time according to an aperiodic function of time (e.g., a random function of time, a pseudo-random function of time, etc.).

In some embodiments, the antenna 130 may function as a transmit antenna. In such embodiments, the EM scattering elements 134 may scatter EM energy from an EM reference wave to an EM radiative wave, and the Tx/Rx circuitry 112 may be configured to supply a signal to the feeds 120 that excites the EM reference wave on or in the body 132. In some embodiments, the antenna 130 may function as a receive antenna. In such embodiments, the EM scattering elements 134 may scatter EM energy from an EM radiative wave to an EM reference wave, which may excite a signal fed through the feeds 120 to the Tx/Rx circuitry 112.

The antenna 130 may be configured for use in a variety of practical applications. By way of non-limiting example, the antenna 130 may function as a communication antenna. Also by way of non-limiting example, the antenna 130 may function as a power transfer antenna.

Figure 2:
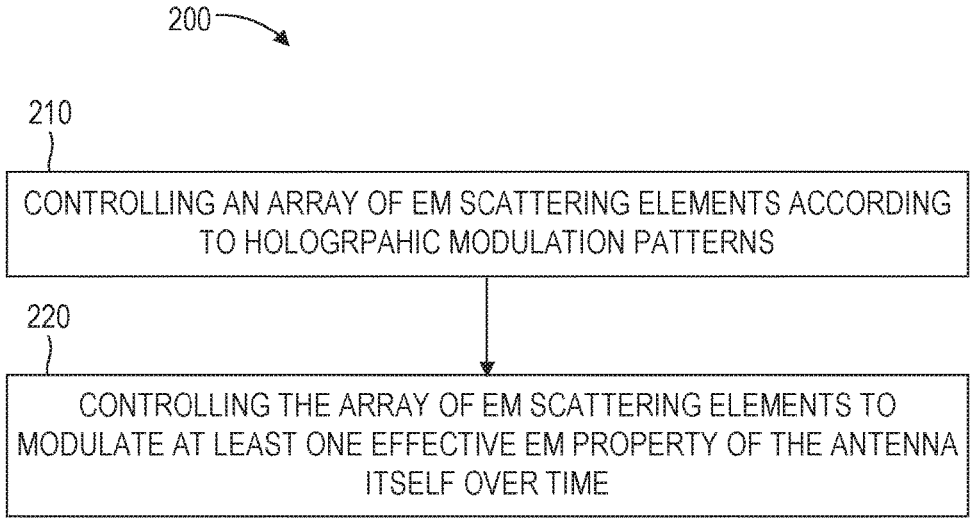
FIG. 2 is a simplified flowchart illustrating a method of operating an antenna system, according to some embodiments.

FIG. 2 is a simplified flowchart illustrating a method 200 of operating an antenna system (e.g., the antenna system of FIG. 1), according to some embodiments. In some embodiments, at least a portion of the method 200 may be implemented by the controller 114, 414. Referring to FIGS. 1 and 2 together, the method 200 includes controlling 210 an array of EM scattering elements 134 of an antenna 130 through control inputs 138 of the antenna 130 to operate according to a holographic modulation pattern.

The method 200 also includes controlling the array of EM scattering elements 134 to modulate at least one effective EM property of the antenna 130 itself over time to, on average, cause side lobes of an antenna gain of the antenna 130 to be reduced.

Figure 3:
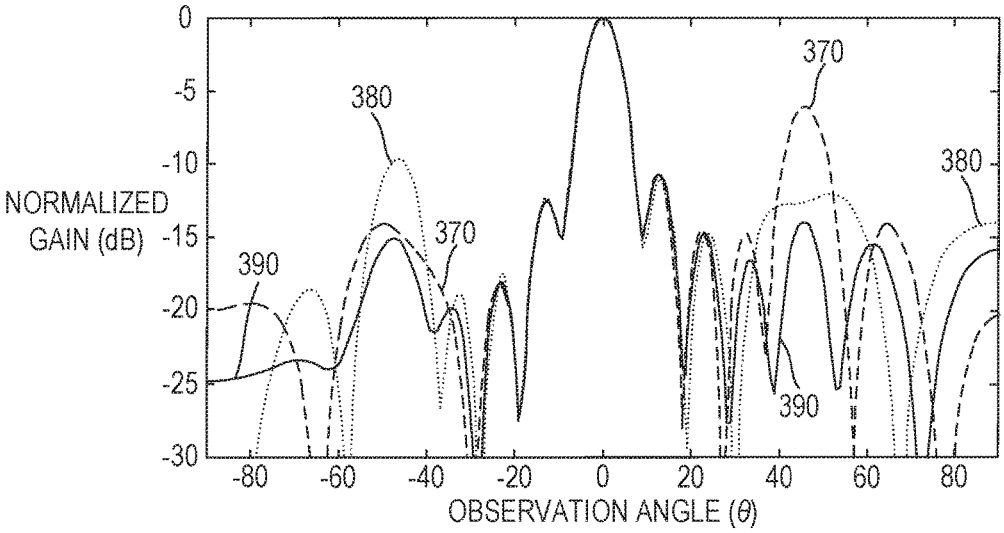
FIG. 3 is a simplified plot illustrating examples of normalized antenna gain of an antenna of FIG. 1, plotted over an observation angle.

FIG. 3 is a simplified plot illustrating examples of normalized antenna gain (indicated in decibels (dB)) 370, 380, and 390 of the antenna 130 of FIG. 1, plotted over an observation angle θ, indicated in degrees. For example, with the antenna 130 controlled to have zero spatial holographic phase ϕ that remains constant over time, a zero-phase antenna gain 370 results. As can be observed from FIG. 3, the zero-phase antenna gain 370 includes a main beam at about zero degrees. The zero-phase antenna gain 370 also includes a relatively large side lobe at about 50 degrees. The zero-phase antenna gain 370 further includes other smaller side lobes, as can be seen in FIG. 3.

With the antenna 130 controlled to have an offset spatial holographic phase ϕ that remains at a constant offset from zero over time, an offset-phase antenna gain 380 results. As can be observed by inspecting FIG. 3, the offset-phase antenna gain 380 includes a main lobe at about zero degrees similar to that of the zero-phase antenna gain 370. Accordingly, the main beam did not change greatly as a result of a change in the spatial holographic phase ϕ as compared to that of the zero-phase antenna gain 370. The largest side lobe of the offset-phase antenna gain 380, however, is at about −50 degrees, which is quite different from that of the zero-phase antenna gain 370. It can also be observed that many of the smaller side lobes of the offset-phase antenna gain 380 are different from those of the zero-phase antenna gain 370.

As the main beams of the zero-phase antenna gain 370 and the offset-phase antenna gain 380 are relatively close to the same, a switched-phase antenna gain 390 resulting from averaging a switching between the zero phase and the switched phase has a main lobe that is similar to those of the zero-phase antenna gain 370 and the offset-phase antenna gain 380. It may be observed, however, that the largest side lobes of the switched-phase antenna gain 390 are smaller than those of the zero-phase antenna gain 370 and the offset-phase antenna gain 380. Accordingly, in this example, modulating an EM property, namely the spatial holographic phase, of an antenna 130 over time results in lower side lobes, in the aggregate, than for constant spatial holographic phase operation.

Rather than, or in addition to, modulating one or more EM properties of the antenna 130 over time, the EM properties of the antenna may be modulated over space to achieve reduced side lobes. In some embodiments, a holographic antenna may include multiple segments (e.g., one-, two-, or three-dimensional overlapping or non-overlapping segments), and each of the segments may be implemented with its own spatial phase of the hologram. By way of non-limiting example, the holographic antenna may include a two-dimensional array of EM scattering elements including an arrangement of multiple one-dimensional arrays of EM scattering elements). Each one-dimensional array may be implemented with its own spatial phase of the hologram. This spatial phase may be varied between the different arrays (e.g., rather than varied over time). For example, in terms of a naïve hologram, the modulation pattern may have the form:

$$\psi_{holo}(x, y)=\cos(k_0 x(\sin(\theta)+n_{eff})+\phi(y)),\ \phi(y)=\varphi_{max}\sin Ky.$$

Since a far-field of this two-dimensional array is a coherent sum of the fields from each of the one-dimensional segments, the summation has an effect on side lobes similar to that of the temporal modulation discussed above.

A functional dependence of the spatial phase on the array index in the y-direction need not be sinusoidal. For example, this technique may be used with sign Ky (rectangular periodic functions), other periodic functions, and random aperiodic functions.

Figure 4:
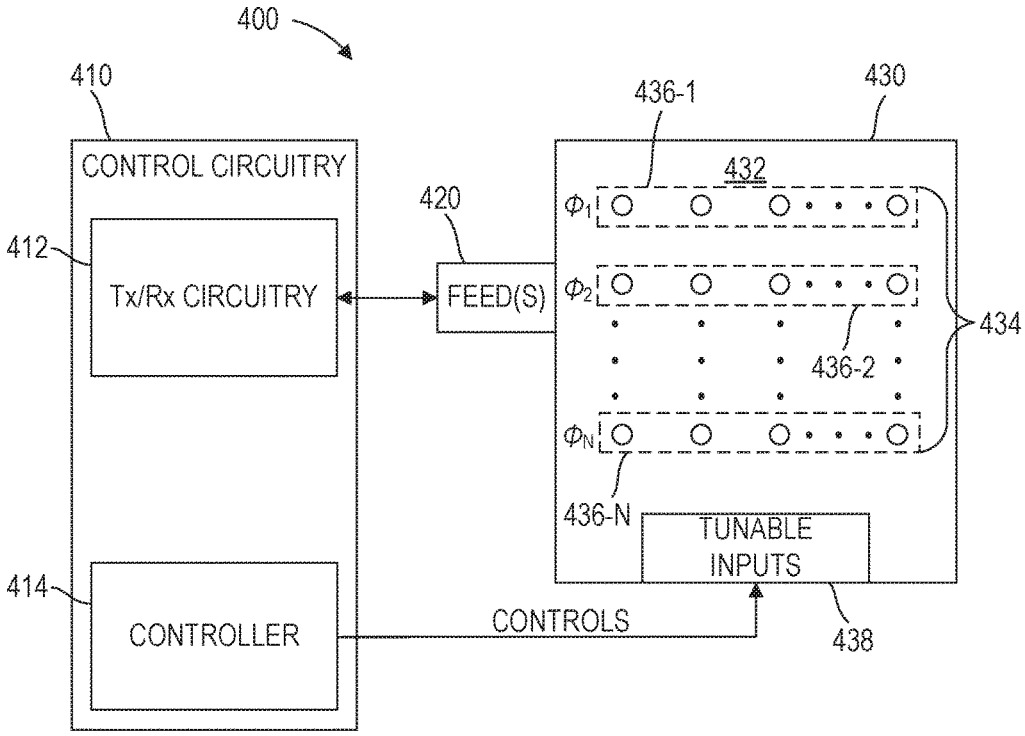
FIG. 4 is a simplified block diagram of an antenna system, according to some embodiments.

FIG. 4 is a simplified block diagram of an antenna system 400, according to some embodiments. The antenna system 400 includes control circuitry 410 (including Tx/Rx circuitry 412 and a controller 414), one or more feeds 420, and an antenna 430 (including a body 432 carrying EM scattering elements 434 and tunable inputs 438). The control circuitry 410, the feeds 420 and the antenna 430 may be similar to the control circuitry 110, the feeds 120, and the antenna 130 discussed above with reference to FIG. 1. The controller 414, however, may be configured to control the EM scattering elements 434 to modulate effective EM properties of the antenna 430 itself over separate segments 436-1, 436-2, . . . 436-N (sometimes referred to herein together as "segments" 436 and individually as "segment" 436) of the antenna 430 to, in the aggregate, cause side lobes of antenna gain of the antenna 430 to be reduced.

For example, a main lobe of an antenna gain for each of the segments 436-1, 436-2, . . . 436-N may point in about the same direction, but the side lobes of the antenna gain for each of the segments 436-1, 436-2, . . . 436-N may point in different directions. As a result, the main lobes for each of the segments 436-1, 436-2, . . . 436-N may roughly sum together. Also, nulls in the antenna gains of the segments 436-1, 436-2, . . . 436-N may cancel out side lobes in others of the antenna gains of the other segments 436-1, 436-2, . . . 436-N. As a result, side lobes will be reduced, as compared to a system where the side lobes for each segment 436-1, 436-2, . . . 436-N point in similar directions (which may result from sharing a similar EM property such as a spatial holographic phase).

In some embodiments, the segments 436 may each include a one-dimensional arrangement of the EM scattering elements 434. In some such embodiments, the segments 436 may be co-linear, forming a one-dimensional array of EM scattering elements 434. In some embodiments, the segments 436 may be arranged in a two-dimensional array of EM scattering elements 434 arranged in one-dimensional segments 436. In some embodiments, the segments 436 may include two-dimensional or even three-dimensional segments. In some embodiments, the EM scattering elements 434 may be grouped into segments 436 including one-dimensional segments, two-dimensional segments, three-dimensional segments, or combinations thereof.

In some embodiments, the controller 414 is configured to modulate a spatial holographic phase $\phi$ over the separate segments 436. By way of non-limiting example, the segments 436-1, 436-2, . . . 436-N may have effective mode indices $\phi_1$, $\phi_2$, . . . $\phi_N$ (e.g., with each of the effective mode indices being different, with those with even indices having a first value and those with odd indices a second value, other arrangements, in a grated fashion, randomly, etc.). In some embodiments, the controller 414 is configured to modulate an effective mode index $\eta_{eff}$ over the separate segments 436. In some embodiments, the controller 414 may be configured to modulate both the spatial holographic phase $\phi$ and the effective mode index $\eta_{eff}$ over the separate segments.

In some embodiments, the controller 414 may modulate the EM property over the separate segments such that at least two different values of the EM property may manifest in at least two of the separate segments 436. In some embodiments, the controller 414 may modulate the EM property over the separate segments 436 such that more than two separate segments 436 manifest more than two different values of the EM property.

In some embodiments, the controller 414 may modulate the EM property over the separate segments 436 according to a periodic function of space (e.g., a single-frequency sinusoidal function of space, a rectangular periodic function of space, etc.), an aperiodic function of space (e.g., a random or pseudo-random aperiodic function of space), or other functions of space.

Similar to the antenna system 100, the antenna system 400 may be used in a transmit configuration, a receive configuration, or a combination thereof. Also, the antenna system 400 may be used in data transmission, power transmission, or other transmissions.

It should be noted that since the antenna system 400 is configured to modulate the EM property over space, it may be possible to implement the antenna 430 without using the controller 414. For example, the modulated pattern for the EM property may be built into the antenna 430 for static operation, if a main lobe direction is known at manufacturing.

Also, it should be noted that the controller 114, 414 may be configured to modulate the EM property as a function of both time and space. By way of non-limiting example, two different values of the EM property may be applied to the antenna 130, 430 in a pattern (e.g., a checkerboard pattern), and the pattern may be spatially shifted over time. Also by way of non-limiting example, a grated pattern of values of the EM property may be shifted over the antenna 130, 430 as a function of time. As a further non-limiting example, separate segments 436 of the antenna 430 may be configured to modulate values of an effective EM property according to different functions of time.

Figure 5:
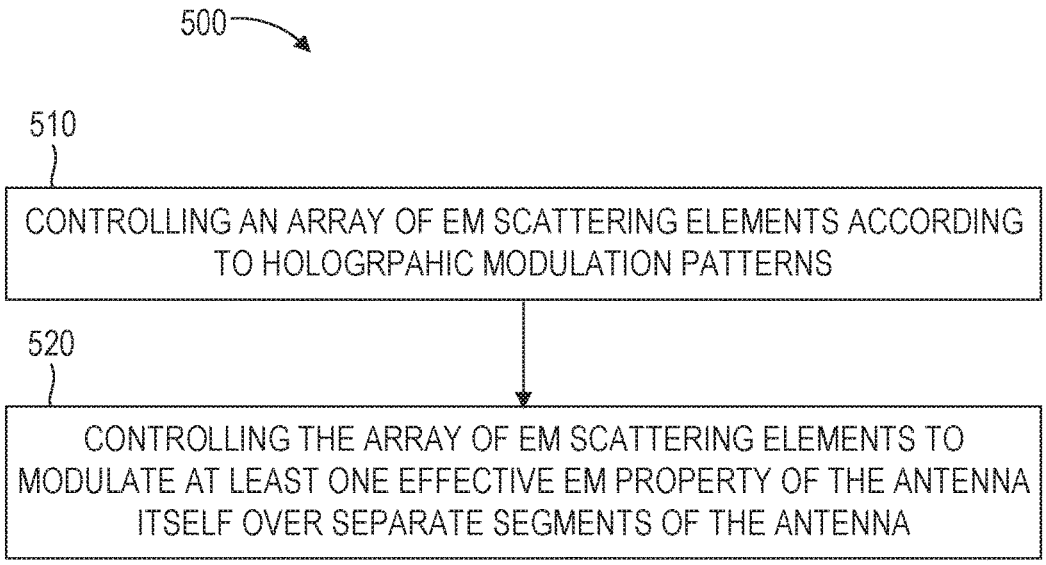
FIG. 5 is a simplified flowchart illustrating a method of operating an antenna system, according to some embodiments.

FIG. 5 is a simplified flowchart illustrating a method 500 of operating an antenna system (e.g., the antenna system 400 of FIG. 4), according to some embodiments. In some embodiments, at least a portion of the method 500 may be implemented by the controller 114, 414. Referring to FIGS. 4 and 5 together, the method 500 includes controlling 510 an array of EM scattering elements 430 (e.g., through tunable inputs 438) to operate according to holographic modulation patterns.

The method 500 also includes controlling 520 the array of EM scattering elements 434 to modulate at least one effective EM property of the antenna 430 itself over separate segments 436 of the antenna 430. In the aggregate, side lobes of an antenna gain of the antenna 430 may be reduced as compared to a situation in which the effective EM property were about the same over the separate segments 436 of the antenna 430.

Figure 6:
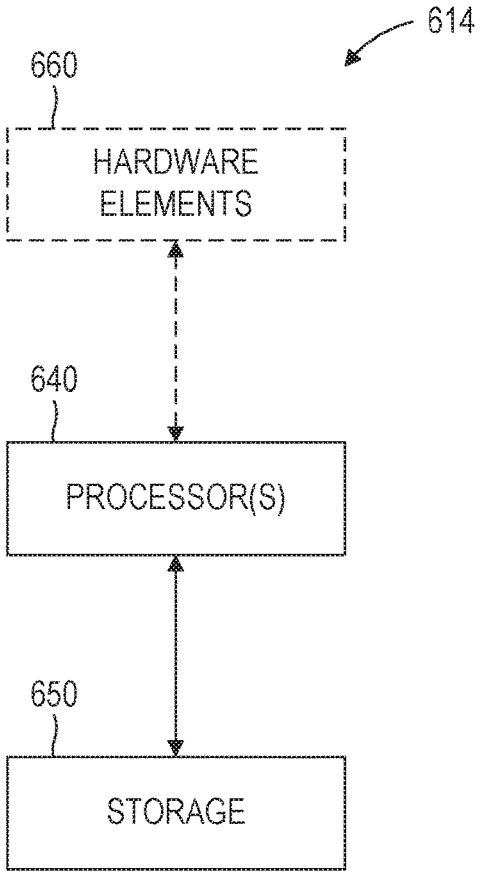
FIG. 6 is a simplified block diagram of an antenna controller, according to some embodiments.

FIG. 6 is a simplified block diagram of an antenna controller 614 (sometimes referred to herein as "controller" 614) according to some embodiments. In some embodiments, the controller 114 and/or the controller 414 of FIGS. 1 and 4, respectively, may be similar to the controller 614. The controller 614 includes at least one processor 640 (sometimes referred to herein as "processor" 640) operably coupled to at least one data storage device 650 (sometimes referred to herein as "storage" 650). The storage 650 is configured to store computer-readable instructions configured to instruct the processor 640 to perform at least a portion of the operations that the controller 114, the controller 414, or a combination thereof is configured to perform. By way of non-limiting example, the computer-readable instructions may be configured to instruct the processor 640 to perform the method 200, the method 500, or a combination thereof.

The processor 640 includes any circuitry configured to execute computer-readable instructions. By way of non-limiting example, the processor 660 may include a central processing unit (CPU), a microcontroller, a programmable logic controller, other controller, or combination thereof.

The storage 650 includes any device capable of storing computer-readable instructions thereon. By way of non-limiting example, the storage 650 may include volatile data storage (e.g., random access memory (RAM), etc.), non-volatile data storage (e.g., Flash memory, read only memory (ROM), electrically programmable read only memory (EPROM), a hard drive, a solid state drive, etc.), or a combination thereof. In some embodiments, the processor 640 may be configured to transfer computer-readable instructions stored in non-volatile storage to volatile storage for execution.

In some embodiments, the controller 614 may include one or more hardware elements 660 configured to perform at least a portion of the operations the controller 114, 414 is configured to perform, at least a portion of the methods 200, 500, or combinations thereof. The hardware elements 660 may include an array of logic gates hard wired or programmably wired (e.g., a field programmable gate array, or "FPGA") to perform at least a portion of the operations the controller 614 is configured to perform. In some embodiments, the hardware elements 660 may include a system on chip (SOC), an application specific integrated circuit (ASIC), discrete electrical circuit components, other hardware elements, or combinations thereof. Those of ordinary skill in the art will appreciate that any operation that may be performed using a computing device (e.g., the processor 640 and the storage 650) may equivalently be performed using the hardware elements 660. Accordingly, the disclosure contemplates that the totality or any portion of the operations and functions discussed herein may equally be performed by the processor 640 and the storage 650 alone, by the hardware elements 660 alone, or by a combination of the processor 640 and the storage 650 with the hardware elements 660.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. An antenna system, comprising:

an antenna controller configured to operably couple to control inputs of an antenna including an array of electromagnetic (EM) scattering elements having sub-wavelength spacing and carried by a body configured to propagate an EM reference wave, the antenna controller configured to:

control the array of EM scattering elements, through the control inputs, to operate according to a holographic modulation pattern; and control the array of EM scattering elements to modulate a spatial holographic phase of the antenna itself over time to, on average, cause side lobes of an antenna gain of the antenna to be reduced.

2. The antenna system of claim 1, wherein the antenna controller is configured to modulate the spatial holographic phase of the antenna over time by switching the antenna between the holographic modulation pattern having a first spatial holographic phase and another holographic modulation pattern having a second spatial holographic phase that is different from the first spatial holographic phase.

3. The antenna system of claim 1, wherein the antenna controller is configured to modulate the spatial holographic phase of the antenna over time by switching the antenna between the holographic modulation pattern and two or more other holographic modulation patterns, the holographic modulation pattern and the two or more other holographic modulation patterns each having different spatial holographic phases.

4. The antenna system of claim 1, wherein the antenna controller is configured to modulate the spatial holographic phase of the antenna over time according to a single-frequency sinusoidal function of time.

5. The antenna system of claim 1, wherein the antenna controller is configured to modulate the spatial holographic phase of the antenna over time according to a rectangular periodic function of time.

6. The antenna system of claim 1, wherein the antenna controller is configured to modulate the spatial holographic phase of the antenna over time according to a periodic function of time.

7. The antenna system of claim 1, wherein the antenna controller is configured to modulate the spatial holographic phase of the antenna over time according to an aperiodic function of time.

8. The antenna system of claim 1, wherein the antenna controller is configured to modulate the spatial holographic phase of the antenna over time according to a random aperiodic function of time.

9. The antenna system of claim 1, wherein the antenna controller is configured to modulate an effective mode index of the antenna over time.

10. The antenna system of claim 9, wherein the antenna controller is configured to modulate the effective mode index of the antenna over time by switching the antenna between the holographic modulation pattern having a first effective mode index and a second holographic modulation pattern having a second effective mode index that is different from the first effective mode index.

11. The antenna system of claim 9, wherein the antenna controller is configured to modulate the effective mode index of the antenna over time by switching the antenna between the holographic modulation pattern and two or more other holographic modulation patterns, the holographic modulation pattern and the two or more other holographic modulation patterns each having different effective mode indices.

12. The antenna system of claim 9, wherein the antenna controller is configured to modulate the effective mode index of the antenna over time according to a single frequency sinusoidal function of time.

13. The antenna system of claim 9, wherein the antenna controller is configured to modulate the effective mode index of the antenna over time according to a rectangular periodic function of time.

14. The antenna system of claim 9, wherein the antenna controller is configured to modulate the effective mode index of the antenna over time according to a periodic function of time.

15. The antenna system of claim 9, wherein the antenna controller is configured to modulate the effective mode index of the antenna over time according to an aperiodic function of time.

16. The antenna system of claim 9, wherein the antenna controller is configured to modulate the effective mode index of the antenna over time according to a random aperiodic function of time.

17. The antenna system of claim 1, wherein the antenna controller is configured to modulate both a spatial holographic phase and an effective mode index of the antenna over time.

18. The antenna system of claim 1, further comprising:

the body; and the EM scattering elements of the array, wherein the EM scattering elements are configured to scatter EM energy at least one of:

from the EM reference wave to an EM radiative wave; and from the EM radiative wave to the EM reference wave.

19. The antenna system of claim 18, wherein the EM scattering elements are spaced at less than about one half of a wavelength of an operational frequency of the antenna system.

20. The antenna system of claim 18, wherein the EM scattering elements are spaced at less than about one fourth of a wavelength of an operational frequency of the antenna system.

21. The antenna system of claim 18, further comprising one or more feeds configured to deliver the EM reference wave to or receive the EM reference wave from the body.

22. The antenna system of claim 21, further comprising signal generating circuitry configured to operably couple to and deliver a signal to the one or more feeds, the signal configured to excite the EM reference wave on or in the body.

23. The antenna system of claim 21, further comprising signal processing circuitry configured to operably couple to and receive a signal from the one or more feeds, the signal configured to be excited from the EM reference wave on or in the body.

24. The antenna system of claim 18, wherein the EM scattering elements are arranged in a one-dimensional arrangement.

25. The antenna system of claim 18, wherein the EM scattering elements are arranged in a plurality of one-dimensional arrangements.

26. The antenna system of claim 18, wherein the EM scattering elements are arranged in at least a two-dimensional arrangement.

27. The antenna system of claim 18, wherein the EM scattering elements are arranged in at least a three-dimensional arrangement.

28. An antenna system, comprising:

an antenna controller configured to operably couple to control inputs of an antenna including an array of electromagnetic (EM) scattering elements having sub-wavelength spacing and carried by a body configured to propagate an EM reference wave, the antenna controller configured to:

control the array of EM scattering elements, through the control inputs, to operate according to holographic modulation patterns; and control the array of EM scattering elements to modulate a spatial holographic phase over separate segments of the antenna to, in the aggregate, cause side lobes of an antenna gain of the antenna to be reduced.

29. The antenna system of claim 28, wherein each of the separate segments of the antenna corresponds to a separate one-dimensional arrangement of a portion of EM scattering elements of the array of EM scattering elements.

30. The antenna system of claim 28, wherein the antenna controller is configured to modulate the spatial holographic phase over the separate segments of the antenna by controlling the separate segments to operate with two different spatial holographic phases in at least two of the separate segments.

31. The antenna system of claim 28, wherein the antenna controller is configured to modulate the spatial holographic phase over the separate segments of the antenna by controlling the separate segments to operate with more than two different spatial holographic phases in more than two of the separate segments.

32. The antenna system of claim 28, wherein the antenna controller is configured to modulate the spatial holographic phase over the separate segments according to a single frequency sinusoidal function of space.

33. The antenna system of claim 28, wherein the antenna controller is configured to modulate an effective mode index over the separate segments of the antenna.

34. The antenna system of claim 33, wherein each of the separate segments of the antenna corresponds to a separate one-dimensional arrangement of a portion of the array of EM scattering elements.

35. The antenna system of claim 33, wherein the antenna controller is configured to modulate effective mode indices over the separate segments of the antenna by controlling the separate segments of the antenna to operate with two different effective mode indices in at least two of the separate segments.

36. The antenna system of claim 33, wherein the antenna controller is configured to modulate effective mode indices over the separate segments of the antenna by controlling the separate segments of the antenna to operate with more than two different effective mode indices in more than two of the separate segments.

37. The antenna system of claim 33, wherein the antenna controller is configured to modulate effective mode indices over the separate segments according to a single frequency sinusoidal function of space.

38. The antenna system of claim 28, wherein the antenna controller is configured to control the array of EM scattering elements to modulate both a spatial holographic phase and an effective mode index of the antenna over separate segments of the antenna.

39. A method of operating an antenna system, the method comprising:

controlling an array of electromagnetic (EM) scattering elements of an antenna through control inputs of the antenna to operate according to a holographic modulation pattern, the array of EM scattering elements having sub-wavelength spacing and carried by a body configured to propagate an EM reference wave; and controlling the array of EM scattering elements to modulate a spatial holographic phase of the antenna itself over time to, on average, cause side lobes of an antenna gain of the antenna to be reduced.

40. An antenna system, comprising:

an antenna controller configured to operably couple to control inputs of an antenna including an array of electromagnetic (EM) scattering elements having sub-wavelength spacing and carried by a body configured to propagate an EM reference wave, the antenna controller configured to:

control the array of EM scattering elements, through the control inputs, to operate according to a holographic modulation pattern; and control the array of EM scattering elements to modulate an effective mode index of the antenna itself over time to, on average, cause side lobes of an antenna gain of the antenna to be reduced.

41. A method of operating an antenna system, the method comprising:

controlling an array of electromagnetic (EM) scattering elements of an antenna through control inputs of the antenna to operate according to a holographic modulation pattern, the array of EM scattering elements having sub-wavelength spacing and carried by a body configured to propagate an EM reference wave; and controlling the array of EM scattering elements to modulate an effective mode index of the antenna itself over time to, on average, cause side lobes of an antenna gain of the antenna to be reduced.

* * * * *